US005483856A

United States Patent [19]

Smitterberg et al.

[11] Patent Number: 5,483,856

[45] Date of Patent: Jan. 16, 1996

[54] APPARATUS AND METHOD FOR SLITTING CORRUGATED PAPERBOARD BOXES

[75] Inventors: Dean W. Smitterberg, Prentice; William R. Nachtrab, Jr., Phillips; David G. Kadlecek, Park Falls; Bruce H. Beutler, Phillips, all of Wis.

[73] Assignee: Marquip, Inc., Phillips, Wis.

[21] Appl. No.: 341,752

[22] Filed: Nov. 18, 1994

Related U.S. Application Data

[63] Continuation-in-part of Ser. No. 65,935, May 24, 1993, Pat. No. 5,375,492, which is a continuation-in-part of Ser. No. 878,681, May 5, 1992, abandoned.

[51] Int. Cl.[6] ..... B26D 1/46; B31B 1/14

[52] U.S. Cl. ..... 83/23; 83/29; 83/419; 83/420; 83/424; 83/468.6; 83/788

[58] Field of Search ..... 83/13, 23, 29, 83/419, 420, 421, 424, 431, 468.6, 468.7, 788, 814, 816; 493/56, 369, 343, 372

[56] References Cited

U.S. PATENT DOCUMENTS

| | | | |
|---|---|---|---|
| 3,393,538 | 7/1968 | Mercier | 83/874 X |
| 4,397,598 | 8/1983 | Ess et al. | 83/468.6 X |
| 4,597,748 | 7/1986 | Wolf | 493/29 |
| 4,850,257 | 7/1989 | Mohr | 83/420 X |
| 5,090,281 | 2/1992 | Paulson et al. | 83/13 |
| 5,158,522 | 10/1992 | Cummings et al. | 493/370 |
| 5,165,314 | 11/1992 | Paulson et al. | 83/29 |
| 5,184,533 | 2/1993 | Golicz | 83/24 |

*Primary Examiner*—Eugenia Jones
*Attorney, Agent, or Firm*—Andrus, Sceales, Starke & Sawall

[57] ABSTRACT

An apparatus and method for slitting a stack of folded corrugated paperboard boxes utilizes a thin slitting blade mounted for continuous movement through a slitting station and defining a vertical slitting plane. A stack supporting table straddles the slitting blade to support a stack of boxes in a stand-by position above the blade. Adjustable upstream and downstream squaring devices are operative to square and center the stack in the cutting plane and a vertically reciprocable ram operates to move the stack and the supporting table downwardly past the blade against a table biasing force to slit the stack into two half-size stacks. The squaring device is operable to re-square the slit half-size stacks prior to conveyance out of the slitting station. The slitting run of the continuous blade operates in a rigid blade holder which is adjustable to compensate for blade wear and to maintain the cutting edge of the blade in a fixed plane. The drum-like pulleys around which the slitting blade runs include a blade bias adjustment device which is used to maintain carefully monitored support of the blade in the blade holder to minimize wear and provide proper blade support along its full slitting run.

15 Claims, 12 Drawing Sheets

FIG. 6
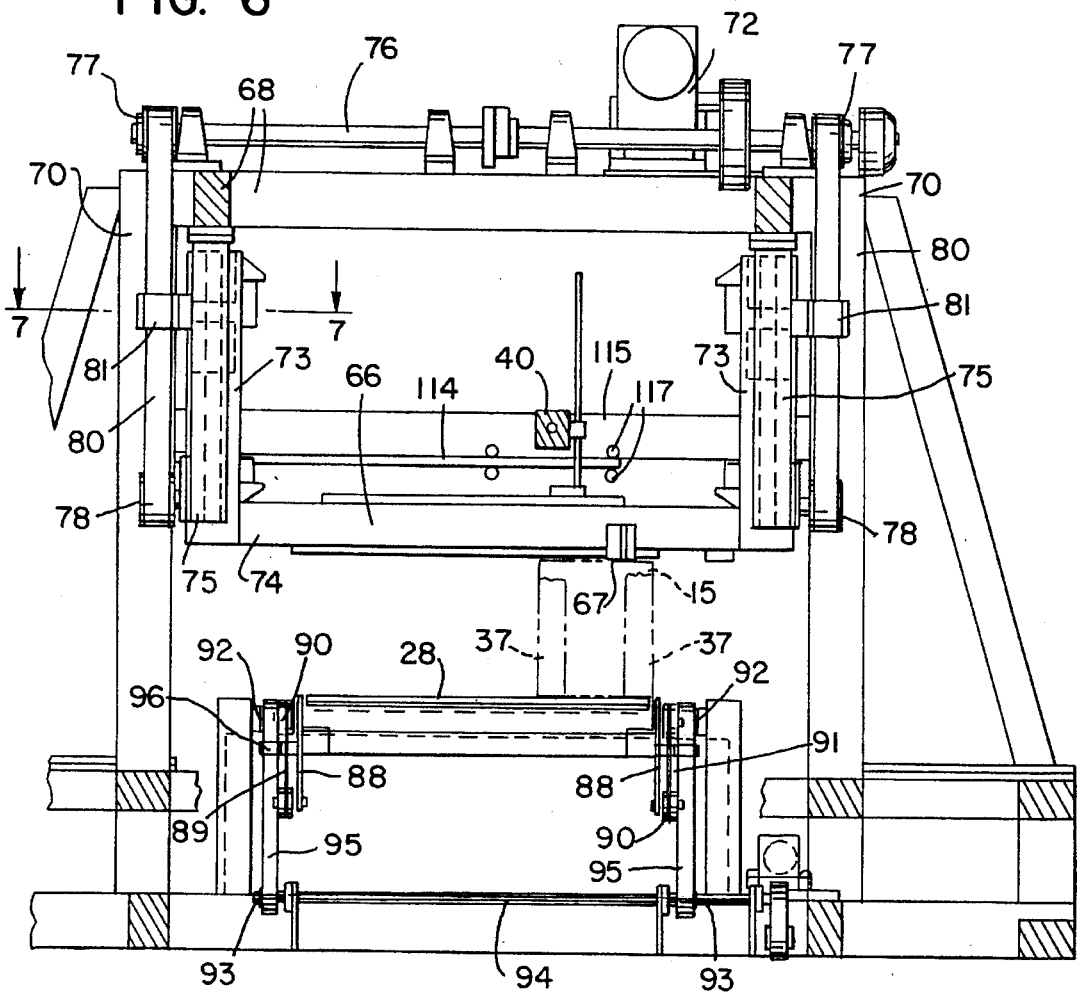
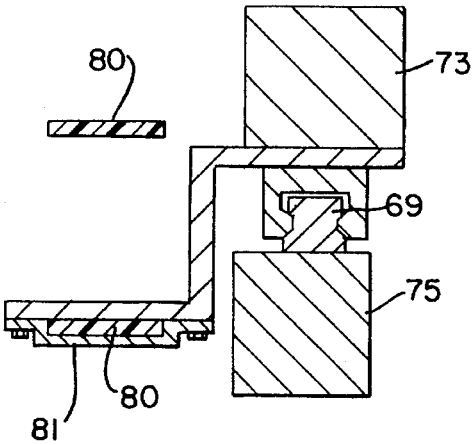
FIG. 7

FIG. 9
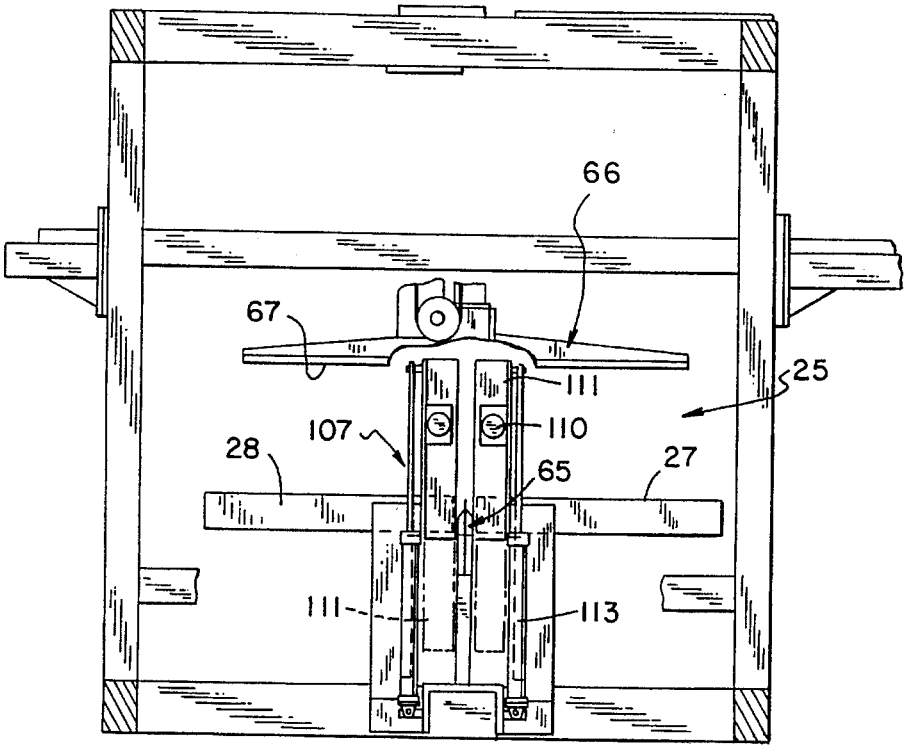
FIG. 10
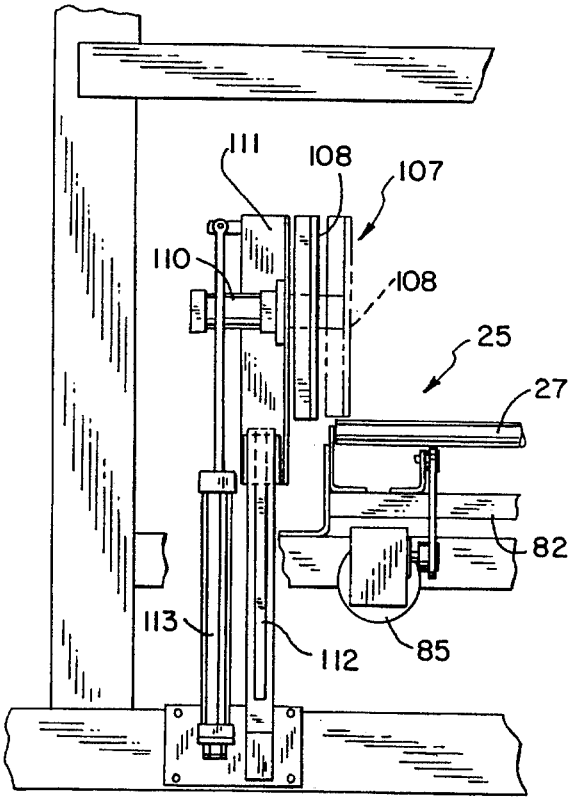
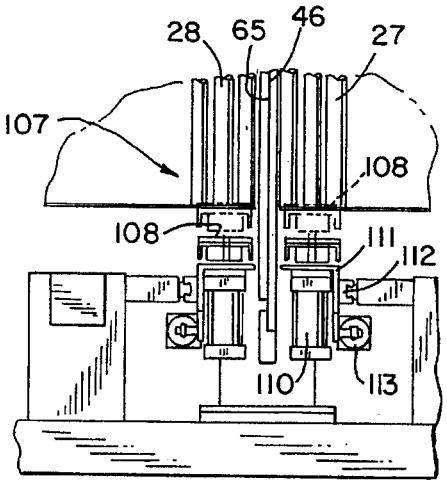
FIG. 11

FIG. 19
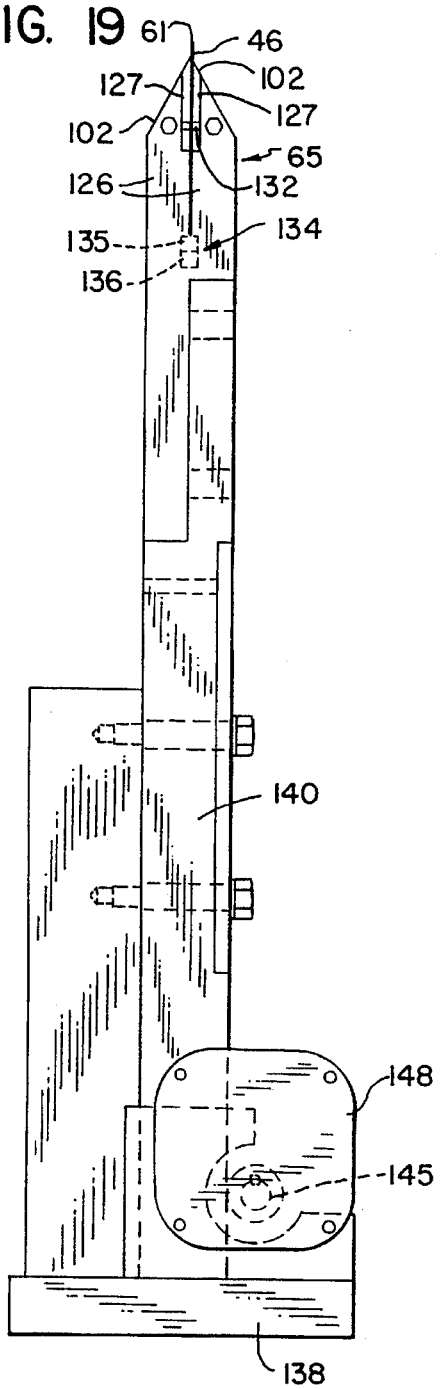
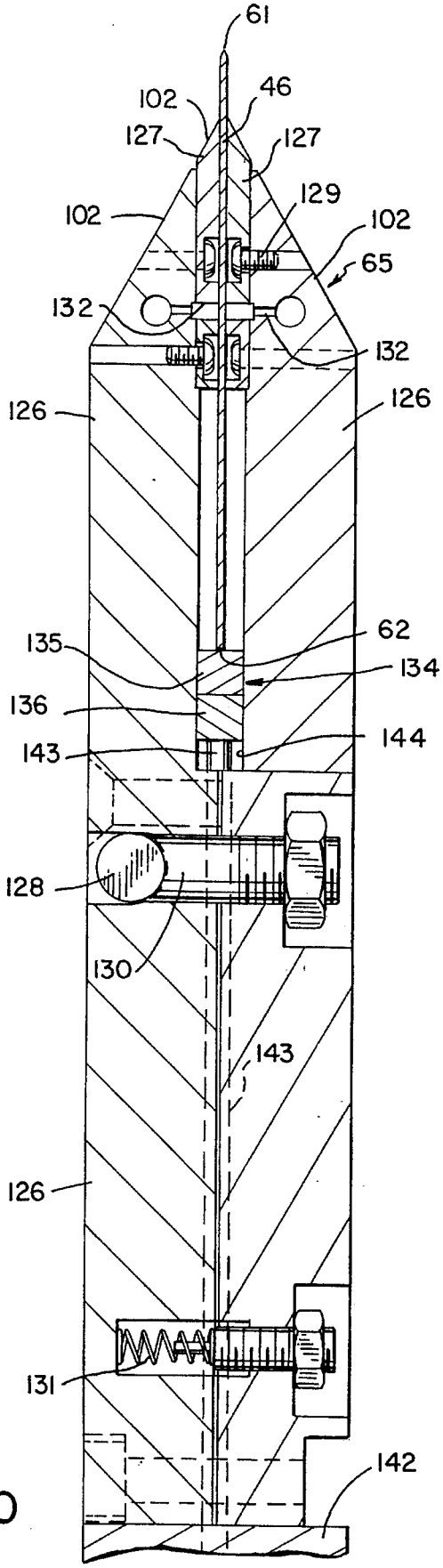
FIG. 20

APPARATUS AND METHOD FOR SLITTING CORRUGATED PAPERBOARD BOXES

This is a continuation-in-part of application Ser. No. 08/065,935, filed May 24, 1993, now U.S. Pat. No. 5,375, 492 which is a continuation-in-part of application Ser. No. 07/878,681, filed May 5, 1992, abandoned.

BACKGROUND OF THE INVENTION

The present invention relates to slitting stacks of sheet material made of corrugated paperboard and, more particularly, to an apparatus and method for slitting knocked down boxes made of corrugated paperboard and formed in a stack in a stacking device as the boxes exit from a folding and gluing apparatus.

Corrugated paperboard box blanks are referred to as "knocked down boxes" in a flexo-folder-gluer apparatus. This apparatus includes a flexographic printer, a folding mechanism which folds opposite sides of the blank along pre-scored lines, and a gluing device which applies an adhesive along the overlapping edges of the laterally folded sides. The flattened container or knocked down box is thus completely formed and, after the glue dries, the boxes can be stacked and banded for shipment and subsequent assembly. It is known in the art to stack the knocked down boxes exiting the flexo-folder-gluer (hereinafter sometimes referred to as a "flexo") to utilize the stack weight to hold the glued edges together until the glue sets. It is also known in the art to form a shingle of knocked down boxes as they exit from the flexo, also utilizing the weight of the overlapping boxes in the shingle to hold the box position until the adhesive dries.

The knocked down boxes typically assembled in a flexo are of a conventional construction, including four sides, the overlapping edges of two sides of which are glued together on a glue tab, and four slotted end flaps extending integrally from opposite ends of the sides to eventually form the top and bottom closure flaps when the box is subsequently assembled. As indicated, these knocked down boxes are ordinarily finished containers and require no further processing, apart from stacking and banding for shipment. However, it is also known in the art to assemble certain special constructions of knocked down boxes in a flexo, which boxes are subsequently slit into two or more parts to form smaller containers of either a conventional or modified type. For example, it is known to assemble a large regular slotted container (RSC) and subsequently slit the same along a median line to form two half slotted containers, each of which comprises a knocked down container with side walls and bottom flaps or top flaps, but not both. Similarly, a large special regular slotted container can be formed in a flexo in the form of two integrally attached half size regular slotted containers by forming the blank with special double length center slots which, when bisected as the large special RSC is subsequently slit in half perpendicular to the center slots, form the two half-size RSCs.

Although the formation of the foregoing types of large knocked down boxes, which must be subsequently slit for end use, is well known, production of such boxes on a large scale has never been achieved, primarily because of difficulties in slitting them. Corrugated paperboard sheet stock is conventionally slit longitudinally by the use of a pair of upper and lower cooperating slitting blades which operate as a shear-type cutter. It has been found, however, that such dual knife shear cutters do not provide clean cuts with heavy and/or multi-wall corrugated board. Shear-type slitting inherently causes a vertical displacement of the adjacent slit edges of the board and, as the board thickness increases or as multiple layers are slit, the relative vertical displacement becomes larger and a ragged cut edge typically results. The multiple board layers presented by a knocked down box result in the same characteristic ragged cuts when shear-type slitters are used.

In addition, slitting large special containers exiting a flexo-folder-gluer has typically been done as an off-line process. In other words, the large knocked down boxes are taken off the flexo, moved to another location, and slit individually to form two half-size knocked down boxes. Even with this technique, the longitudinal slits are typically less than satisfactory because of the use of shear-type slitting devices. In addition, registration of the boxes, meaning lateral alignment so that the slit is directly on the centerline of the large regular or special slotted container, is difficult to attain with conventional off-line methods in which one box at a time is slit.

Nevertheless, real advantages in production volume and box quality could be attained with an apparatus and method which would slit large regular or special slotted containers to form two half-size containers in an on-line basis. Furthermore, small containers are typically not run on a flexo because small container blanks are extremely difficult to handle, not only in the flexo, but in upstream material handling devices as well. Thus, there is a real need in the industry for a system which can provide for the manufacture of high quality small size knocked down boxes, but will also utilize a flexo-folder-gluer in its most effective and efficient manner.

In one known prior art method, the on-line slitting of knocked down boxes is accomplished by forming a shingle of the boxes as they exit the flexo, unshingling the boxes downstream and feeding them one at a time through a conventional shear-type slitter, and then separately reshingling or stacking each of the series of half-size boxes. However, this process is slow, causes loss of box registration, and still results in ragged slit edges on the boxes.

It is also known to form knocked down boxes from a flexo-folder-gluer into a shingle and to slit the shingle on-line using a single thin high speed rotary slitting blade. Various techniques for slitting corrugated boxes in this manner are shown in U.S. Pat. Nos. 5,158,522 and 5,165, 314. The apparatus for slitting such boxes is more broadly described in U.S. Pat. No. 5,090,281. Although high speed slitting with a single rotary slitting blade has improved substantially the quality of cuts, as well as processing speeds, excessive box handling equipment and steps are still required.

In accordance with the invention described in copending and commonly assigned application Ser. No. 065,935 identified above, knocked down boxes from a flexo-folder-gluer are stacked in a conventional counter ejector and the entire stack is transferred into a linear blade slitter which cuts through the entire stack, leaving two stacks of smaller regular slotted containers of either special or conventional construction. It has been found that a thin cutting blade, properly supported and driven at a small enough angle through the stack, can readily cut through a stack of folded knocked down boxes if properly oriented to slit essentially one box at a time and to allow the cut halves to part sequentially as the blade passes through the stack. The downward force of the blade on the layers of corrugated paperboard comprising the boxes will crush the corrugated medium unless the blade is moved through the stack at a small acute angle with respect to the plane of the end face of the stack (the plane of the means used to support the stack). Various types of linear slitting blades may be used, including a thin flexible blade clamped in a rigid blade support to expose only a small edge portion which defines the required slitting depth. The blades may be moved through the stack for cutting on a linear track means mounted for reciprocal movement through the cutting and return strokes.

In another embodiment, the cutting blade may comprise a continuous flexible band which operates linearly in one direction through a rigid blade guide with the guide and moving blade operated to pass directly through the stack of boxes. In this embodiment, linear blade movement is preferably at a speed about ten times as great as the speed of movement of the blade through the stack in a direction normal to the linear blade movement. Band blade slitting apparatus including rigid adjustable blade guide mechanisms have been developed for use in other slitting applications as shown, for example, in U.S. Pat. No. 3,393,538.

SUMMARY OF THE INVENTION

In accordance with the present invention, it has been found that a cutting blade comprising a continuous flexible band is particularly well suited to slit a stack of corrugated paperboard boxes when the blade is mounted to operate with the blade edge in a fixed horizontal plane and the stack of boxes and stack supporting table are moved vertically through the blade. The present invention also relates to specific improvements in the blade holder for such a continuously operating flexible band blade.

The apparatus of the present invention includes a slitting station with a stack supporting table; means for moving the stack onto the table in a direction normal to the cut edges of the boxes comprising the stack; a downstream squaring device which is movable into the path of stack movement and has a squaring face which is adapted to engage the downstream face of the stack; a slitting blade mounted in the slitting station and movable transversely with respect to the path of stack movement; the blade having a horizontally disposed slitting edge which is positioned in a vertical cutting plane parallel to the cut edges of the boxes; an upstream squaring device which is movable into the path of stack movement and has a squaring face adapted to engage the upstream face of the stacked boxes; a centering device which mounts the downstream and upstream squaring devices for movement parallel to the direction of stack movement and for centering the stack in the cutting plane; and, a moving device adapted to move the stack supporting table and the stack of boxes vertically relative to and through the slitting edge of the blade to slit the stack on the cutting plane and form two stacks of smaller boxes.

The stack supporting table and moving device comprises a conveyor which has upstream and downstream sections positioned on a opposite sides of the cutting plane. The supporting table is preferably movable downwardly from an upper stack receiving and discharge position above the blade edge. To provide such movement, a stack-engaging ram is mounted in the slitting station above the supporting table and the stack of boxes supported thereon; an upwardly-biased retracting support is operative to exert an upward force sufficient to normally hold the table and stack in the upper position; and, a drive for the ram is operative to move the ram into engagement with the top of the stack to overcome the upward force of the biased support and to move the stack and table downwardly past the blade edge.

The centering device preferably comprises a drive supporting the squaring devices for common linear reciprocating movement, said centering drive being operative to bring the first and second squaring faces into a centering position in contact with the downstream and upstream stack faces, respectively, in vertical planes equidistant from the cutting plane. The centering drive includes means for locking the squaring devices in the centering position. Preferably, the blade edge is maintained in a fixed horizontal plane and the table and stack are supported for downward movement past the blade edge, and the squaring devices are maintained fixed above the blade during downward movement of the stack; a squaring face extender is provided for each squaring device, each of which extenders is mounted to extend downwardly from the lower end of the squaring device in response to downward movement of the stack to present downstream and upstream edge stops which are engaged by the downstream and upstream box edges to limit parting movement of smaller boxes forming the respective downstream and upstream stacks. In the preferred embodiment, the downstream and upstream squaring devices each comprise a pair of independently positionable paddles which have coplanar face portions defining, respectively, the first and second squaring faces.

The centering device of the present invention is preferably operable, after formation of the two stacks of smaller boxes and movement of the downstream squaring device out of the path of stack movement, to move the upstream squaring device in the downstream direction to move the two stacks into mutual engagement and to re-square the stack faces.

The method of the present invention includes the steps of: moving the stack in a direction normal to the cut edges onto a stack supporting table; positioning a downstream squaring device in the path of movement in the slitting station to engage the downstream face of the stack; positioning an upstream squaring device in the path of stack movement adjacent the upstream stack face; mounting a slitting blade below the stack supporting table, the blade having a horizontally disposed slitting edge which is movable transversely with respect to the path of box movement, which blade edge is disposed upwardly and positioned in a vertical cutting plane parallel to the cut edges of the boxes; moving the downstream and upstream squaring devices toward one another to engage the opposite stack faces and center the stack in the cutting plane; and, moving the stack supporting table and stack of boxes vertically downwardly through the slitting edge of the blade to slit the stack on the cutting plane and form two stacks of smaller boxes.

The method preferably includes the step of extending the downstream and upstream squaring devices vertically downwardly in response to downward movement of the stack supporting table to engage the downstream and upstream edges and to limit parting movement of the smaller boxes forming the respective downstream and upstream stacks. The method also includes the subsequent steps of moving the downstream squaring device out of the path of stack movement, and moving the upstream squaring device in the downstream direction to move the upstream stack of smaller boxes into engagement with the downstream stack and re-square the stack faces. The method also preferably includes the subsequent steps of moving the squaring devices away from one another after slitting, and moving the supporting table and two stacks of smaller boxes vertically upwardly to the initial supporting table position.

In a presently preferred embodiment, a slitting apparatus for a stack of sheet material comprises a cutting blade which is formed from a continuous flexible steel band and includes a butt edge and an opposite sharpened cutting edge, a pair of spaced cylindrical blade drums which are rotatable on vertical axes and support the blade for slitting movement with the blade edge in a horizontal plane and defining a linear slitting path in a vertical plane between and tangent to the surfaces of the drums, a blade holder which supports the cutting blade for movement along the slitting path, which holder includes a pair of jaws with open upper ends having opposite lateral bearing surfaces to slidably engage the opposite side faces of the blade band and an internal portion which is vertically adjustable with respect to the jaws and has a blade supporting bearing surface in sliding engagement with the butt edge of the blade band, a mounting frame for the blade holder which extends generally along the slitting path and includes a base which has blade holder mounts on opposite ends for supporting attachment to the opposite ends of the blade holder for positioning the upper ends of the jaws to expose a selected portion of the blade side faces including the cutting edge, a blade tracking adjustment mechanism interconnecting the mounting frame and the adjustable internal portion of the blade holder and operative to move the blade supporting bearing surface and blade upwardly to maintain the selected blade exposure, a blade drum support frame which includes a pair of support brackets rotatably supporting the drums, one of said brackets having a pivotal attachment to the drum support frame to provide rotational adjustment on a pivot axis normal to the drum axis and to the slitting plane, and a bias adjustment mechanism interconnecting the drum support frame and the drum support bracket and operative to rotate the drum support bracket on its pivot axis and adjust the position of the blade drum rotation axis to maintain a selected biasing force of the blade butt edge on the blade supporting bearing surface.

The blade holder preferably comprises a pair of wear strips which define the lateral bearing surfaces and are attached to and form the upper ends of the jaws, the upper ends of the wear strips and the adjacent upper ends of the jaws defining divergent parting surfaces which extend downwardly from the opposite side faces of the blade. The jaws of the blade holder are interconnected with a mechanism which is operative to bias the jaws closed to hold the lateral bearing surfaces in sliding engagement with the blade side faces. Alternately, the biasing mechanism may be replaced with a rigid set screw assembly. Preferably, the apparatus includes a source of lubricated compressed air which is connected to apertures in the lateral bearing surfaces of the wear strips and forms an air bearing between those surfaces and the side faces of the blade.

Preferably, the blade supporting bearing surface comprises an elongate bar which extends substantially the full length of the blade holder and has a hard bearing surface, such as fine grained tungsten carbide. The blade tracking adjustment mechanism may comprise an adjustment plate mounted for vertical sliding movement between the base of the blade holder mounting frame and the blade holder, a series of laterally spaced vertically disposed pins which are attached at their lower ends to the adjustment plate and extend upwardly through the blade holder jaws with their upper ends in operative engagement with a lower surface of the elongate bar, and an actuator mounted between the blade holder base and the adjustment plate to move the plate, the pins, the elongate bar and cutting blade upwardly simultaneously. The elongate bar is preferably square in cross section and includes four identical hard bearing surfaces.

BRIEF DESCRIPTION OF THE DRAWINGS

FIG. 6 is an end elevation of the apparatus viewed in the upstream direction.

FIG. 7 is an enlarged horizontal section taken on line 7—7 of FIG. 6.

FIG. 9 is a side elevation, similar to FIG. 4, showing details of the side stop mechanism.

FIG. 10 is an end elevation detail of a portion of FIG. 9.

FIG. 11 is a top plan view of FIG. 10.

FIG. 19 is an end elevation of the blade holder.

FIG. 20 is an enlarged vertical section taken on line 20—20 of FIG. 18.

DETAILED DESCRIPTION OF THE PREFERRED EMBODIMENTS

Figure 1:
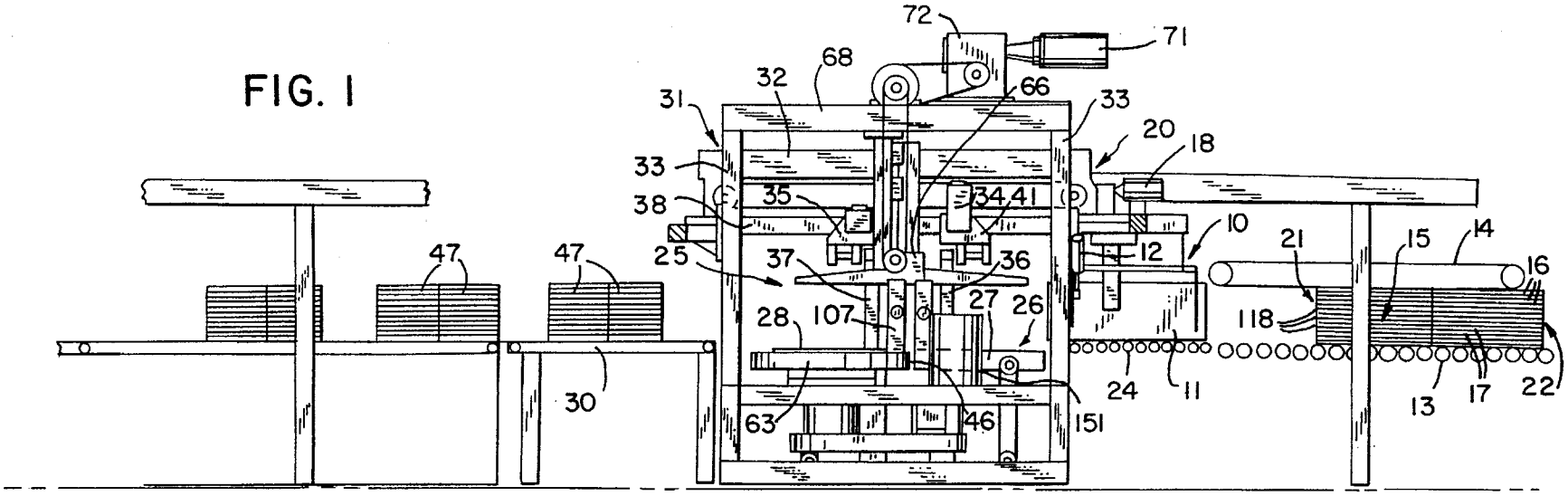
FIG. 1 is a side elevation view of the slitting apparatus of the present invention.
Figure 2:
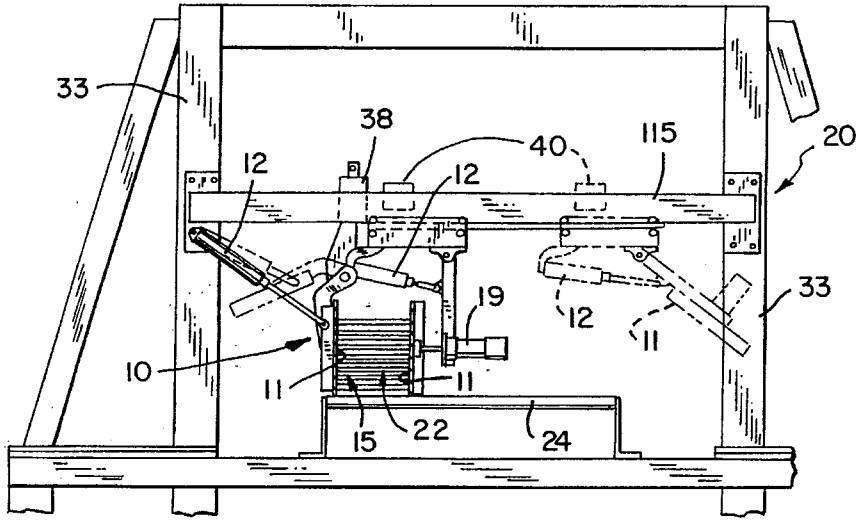
FIG. 2 is an end elevation of FIG. 1 viewed in the downstream direction.

Referring initially to FIGS. 1–4, knocked down boxes of corrugated paperboard are formed from flat blanks in a flexo-folder-gluer (not shown), where the blanks are initially printed and the side edges are folded laterally toward one another and glued together along a thin glue tab on the overlapping edges. The folded knocked down boxes exiting the folding section of the flexo are formed in a vertical stack of a pre-selected number of boxes in a conventional counter ejector (not shown). The corrugated containers made from double wall board (i.e. 3 liners enclosing two corrugated media) may have a folded two layer thickness of 0.625 inch (about 16 mm), such that a stack of 16 boxes formed in the counter ejector would be about 10 inches (25 cm) high. Because of the inherent spring back in the folded boxes, the freestanding stack is somewhat higher and the stack is fed from the counter ejector between a lower discharge conveyor 13 and an upper compression conveyor 14 to compress the stack 15 to a nominal 10 inch height.

It will be appreciated that, as is well known in the industry, the folded edges 17 of the boxes 16 comprise the lateral edges as each box is formed in the flexo and lie parallel to the line of box movement through the flexo. Correspondingly, the cut edges 18 of the boxes are oriented transversely to the direction of box movement. The boxes are moved through the counter ejector and between the conveyors 13 and 14 without any reorientation in the horizontal plane, so that the stack 15 of boxes arrives at the inlet of the box slitting apparatus 20 with the lead or downstream face 21 of the stack defined by the leading cut edges 18.

From the lower discharge conveyor 13, the stack 15 is transferred onto a powered infeed conveyor 24 which, in turn, transfers the stack into the slitting station 25 of the slitting apparatus 20. Because the stacks 15 formed in the upstream counter ejector are rarely truly square, it is desirable, before transferring the stack into the slitting station 25, to square the stack laterally, i.e. to align the folded edges 17 on each side of the stack in respective vertical planes. A side tamp apparatus 10, shown generally schematically in FIG. 1, is positioned above the infeed conveyor 24. A pair of tamper plates 11 (only the near side plate being shown in FIG. 1) are each pivotally mounted to move from an upper inoperative position to a vertical operative position, shown in FIG. 2, in a plane parallel to the folded edges 17 of the boxes in an incoming stack 15. The infeed conveyor 24 is continuously operated to receive the sequentially delivered incoming stacks 15. Each of the plates 11 is rotated downwardly by extension of its own positioning cylinder 12. The far side tamper plate 11 (shown in FIG. 2) is laterally positionable, as will be described in more detail hereinafter, to position it from the near side tamper plate a distance approximating the width of the incoming stack. A laterally extendable tamping cylinder 19 is then extended to tamp and square the stack as it is moved by the infeed conveyor 24 into the slitting station. A lower stack supporting table in the slitting station 25 comprises a powered roller conveyor 26. The roller conveyor 26 includes an upstream section 27 and a downstream section 28 which are separately driven. The powered roller conveyor 26 is normally positioned in an upper stack receiving and discharge position which is coplanar with the infeed conveyor 24 and a downstream outfeed conveyor 30.

The supporting frame 31 includes an upper gantry mechanism 32 which is supported by a horizontal support structure extending between laterally spaced pairs of intermediate vertical support columns 33, the lateral spacing of which is preferably great enough to provide pass-through of unfolded boxes, if desired. The gantry mechanism 32 supports an adjustable upstream squaring device 34 and a similar adjustable downstream squaring device 35, which together aid in maintaining and re-establishing squareness of the stack during and after slitting. The upstream squaring device 34 includes a pair of pivotally mounted squaring paddles 36 which are movable together in either direction on the line of stack movement through the slitting station, adjustable laterally to vary the distance between them in the cross machine direction (normal to the direction of stack movement), and may be pivoted into and out of the path of stack movement. Similarly, the downstream squaring device 35 includes a pair of downstream squaring paddles 37 which are also movable together toward or away from the upstream paddles, adjustable in the cross machine direction to vary the distance between them, and pivotally mounted to rotate into and out of the path of stack movement, all as will be described in greater detail below.

Figure 12:
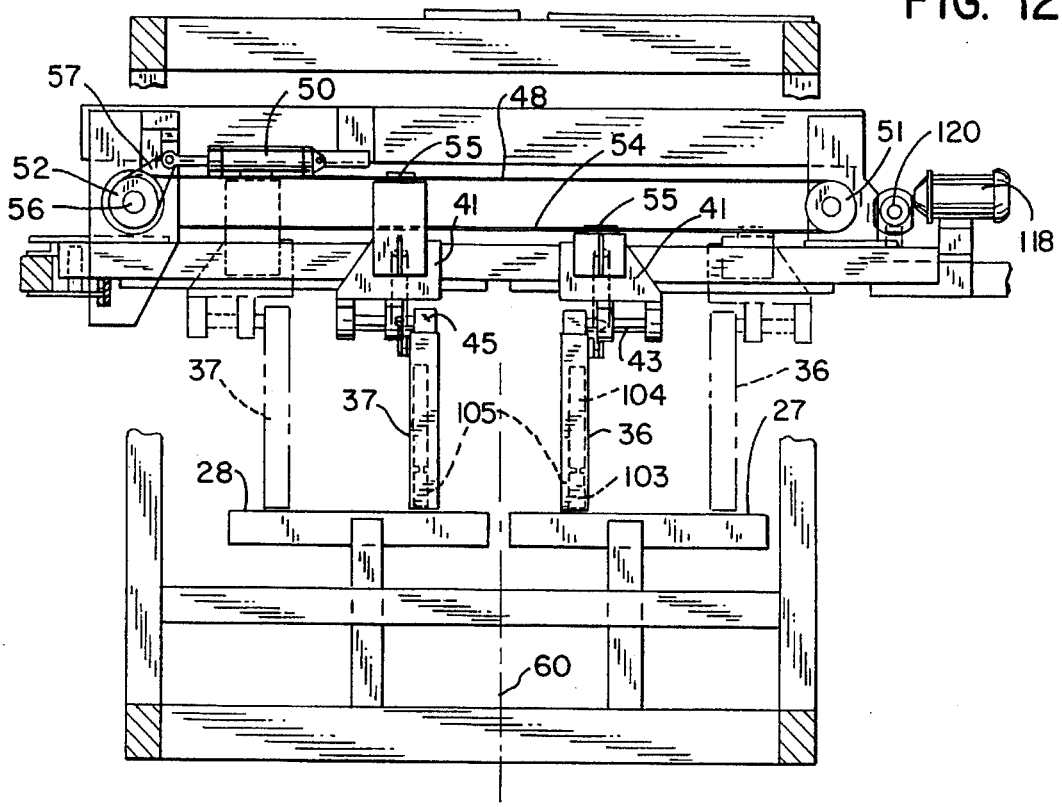
FIG. 12 is a side elevation view showing details of the mechanism for adjusting a paddle spacing in the machine direction.
Figure 13:
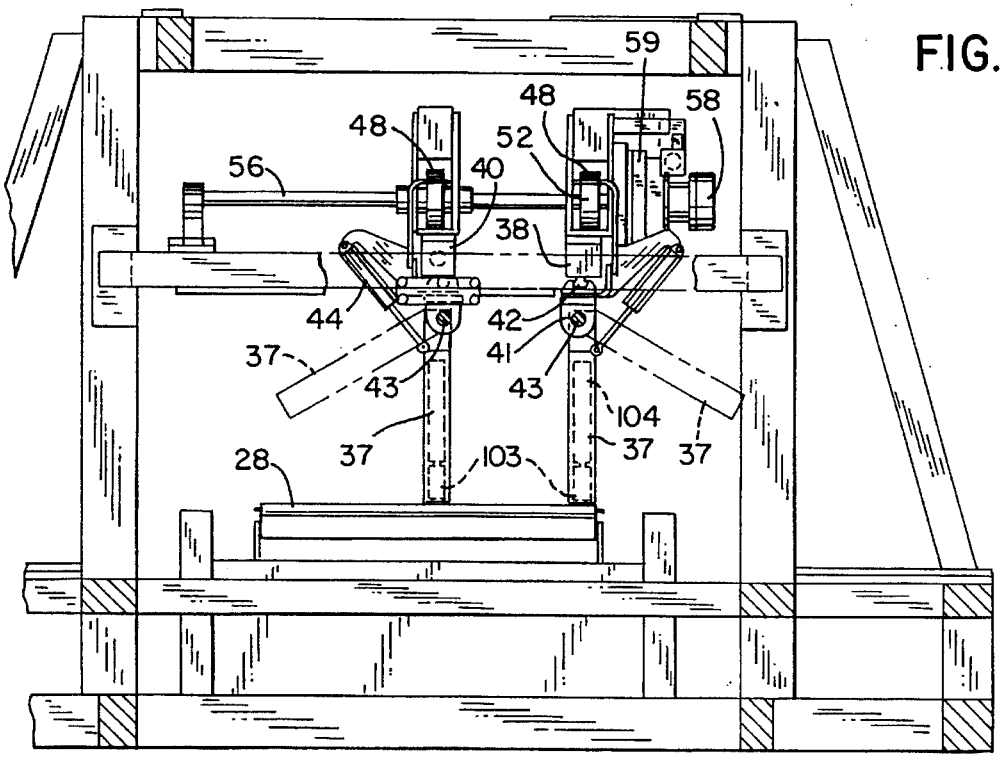
FIG. 13 is an end elevation of the apparatus shown in FIG. 12, viewed in the upstream direction, showing further details of the paddle operating mechanism.

Referring also to FIGS. 6, 12, and 13, one of each pair of upstream squaring paddles 36 and downstream squaring paddles 37 is mounted for opposite reciprocal sliding movement along a fixed paddle supporting beam 38 attached to the supporting structure extending between an upstream and a downstream intermediate column 33 and forming part of the upper gantry mechanism 32. Each of the other pair of upstream and downstream paddles 36 and 37 is similarly supported for reciprocal sliding movement in opposite directions along a laterally adjustable paddle supporting beam 40 parallel to the fixed beam 38. Each of the paddles 36 and 37 is suspended from and pivotally attached to a paddle carriage 41 which, in turn, is mounted on linear bearings 42 to slide along one of the supporting beams 38 or 40 parallel to the direction of movement of the stack 15 through the system. Paddle pivot shafts 43 support each of the paddles from the underside of its respective paddle carriage 41. A paddle pivot arm 45 connects each shaft 43 to the rod end of a paddle cylinder 44, the cylinder end of which is attached to the paddle carriage 41, such that cylinder retraction causes the paddle to pivot from a vertical operative position in the path of stack movement to an upper inoperative position out of the path (the latter position shown in phantom lines in FIG. 13).

Opposite reciprocal movement of each upstream pair of paddles 36 with respect to and in an opposite direction from each downstream pair of paddles 37 is utilized, in conjunction with pivotal movement of the paddles, to perform several distinct sequential functions in the process of bringing a stack 15 of boxes 16 into the slitting station 25, squaring and centering the stack over a slitting blade 46 positioned between the upstream and downstream sections of the supporting conveyor 26, guiding the boxes in the stack as it is moved vertically downwardly through the slitting blade 46, and re-squaring the two half-size stacks 47 of smaller boxes resulting from the slitting operation.

The subsystem for effecting reciprocating movement of each pair of paddles 36 and 37 in the direction of stack movement includes a pair of overhead paddle drive belts 48 which are synchronized to operate simultaneously in the same direction by the reciprocating operation of a drive cylinder 50. Each of the drive belts 48 is positioned above its respective paddle supporting beam 38 or 40 and extends between an upstream idler pulley 51 and a driven downstream splined hub 52 to define an upper belt run 53 and a lower belt run 54. The carriages 41 for each pair of upstream paddles 36 are secured with belt clamps 55 to the lower belt run 54 of its respective belt 48 and, similarly, the paddle carriages for the downstream paddles 37 are secured to the upper runs 53 of the belts 48 with similar belt clamps 55. Thus, synchronized movement of the drive belts 48 together in either direction results in sliding movement of the paddle carriages 41 along the linear bearings 42 of the supporting beams 38 and 40, carrying the respective paddles therewith. A splined driveshaft 56 extends through the splined hubs 52. The driveshaft 56 is rotatably driven in opposite directions by reciprocating movement of the drive cylinder 50, the rod end of which is connected to the shaft 56 by a crank arm 57. A brake 59 is operatively connected to a tooth clutch 58 at the end of the driveshaft 56 to securely lock the paddles in any selected position.

Each of the belt clamps 55 by which a paddle carriage is attached to its drive belt 48 is adjustably positionable so that each pair of upstream paddles 36 and downstream paddles 37 may be initially set to define a distance approximately 3" greater than the length of the stack 15 in the direction of stack movement. In addition, each pair of paddles 36 and 37 is set equidistant upstream and downstream, respectively, from a transverse vertical plane through the slitting blade 46 which defines a vertical cutting plane. Thus, because of the common attachment of the respective paddle pairs to the upper and lower runs 53 and 54 of the synchronized paddle drive belts 48, reciprocal movement of the paddle pairs in opposite directions will always maintain the pairs equidistant from the cutting plane 60 in the respective upstream and downstream directions.

Figure 3:
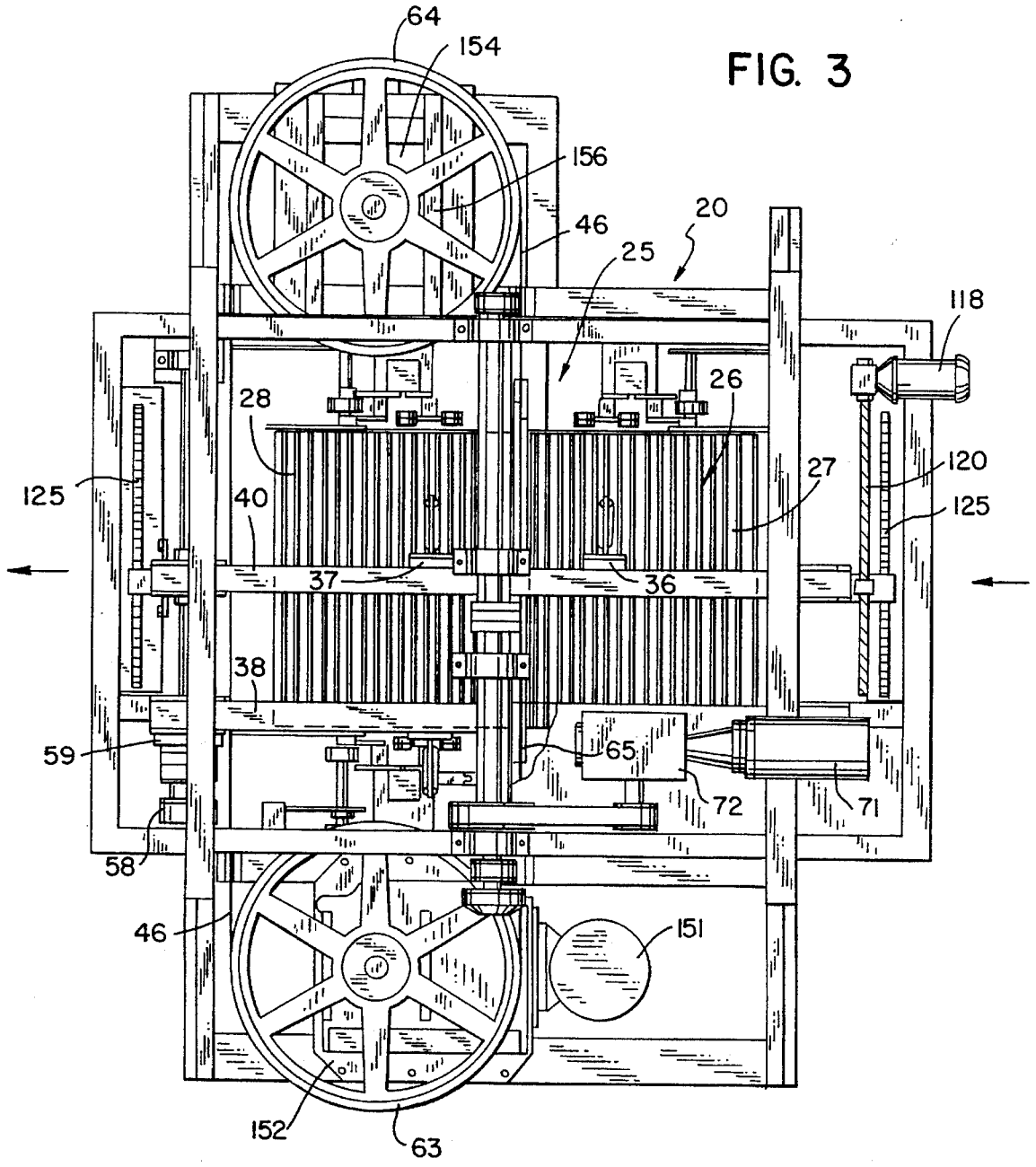
FIG. 3 is a top plan view of the slitting apparatus shown in FIG. 1.
Figure 4:
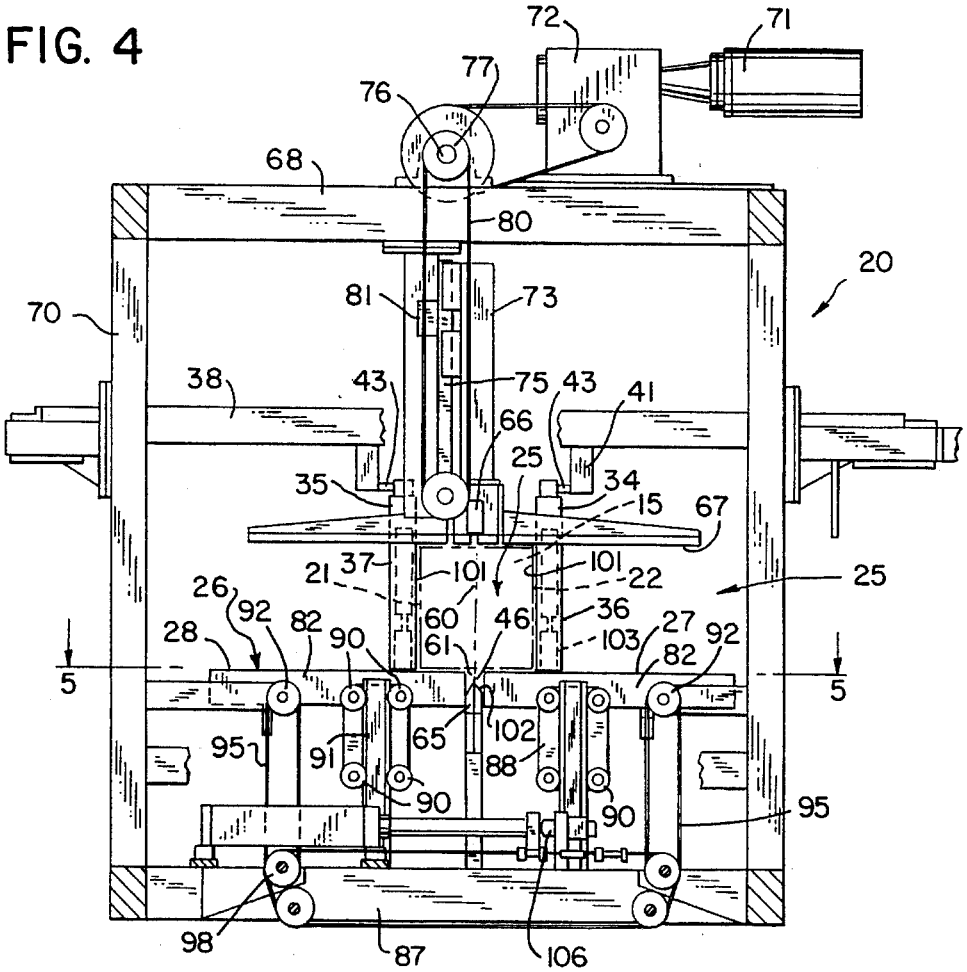
FIG. 4 is a side elevation of the apparatus shown in FIG. 3.
Figure 5:
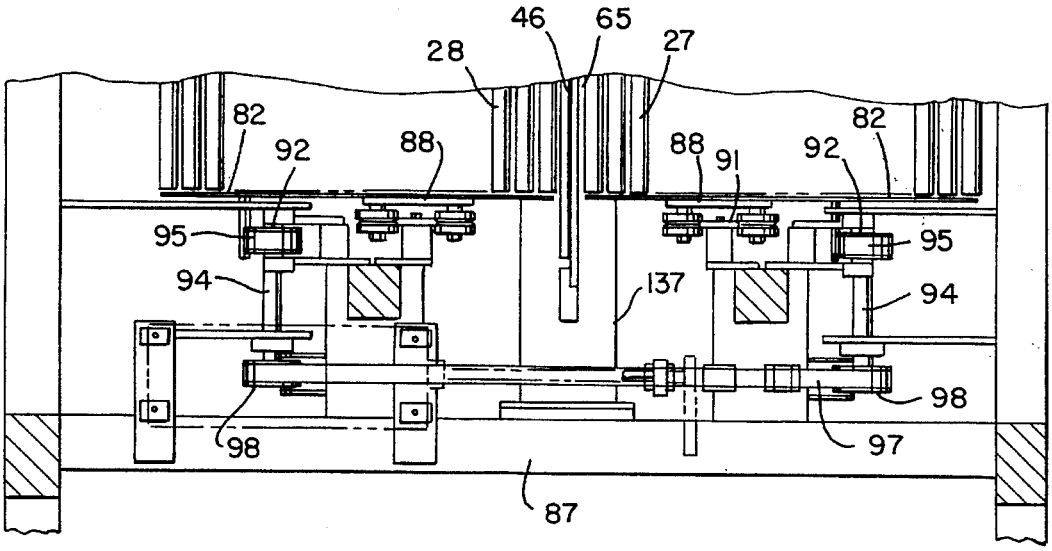
FIG. 5 is a partial horizontal section taken on line 5—5 of FIG. 4.

As shown generally in FIGS. 3, 4 and 20, the slitting blade 46 is made from a continuous flexible steel band having an upwardly oriented cutting edge 61 and an opposite lower butt edge 62. The blade is entrained around a driven blade drum 63 and an idler drum 64 mounted on vertical drum axes on opposite sides of the slitting station 25 and positioned with the upper cutting edge 61 in a horizontal plane and one run of the blade positioned in the vertical cutting plane 60 to define a linear slitting path. The slitting blade 46 is accurately held in the slitting path by an adjustable blade holder 65 which extends substantially the full length of the linear slitting path transversely across the supporting roller conveyor 26 to maintain the cutting edge 61 just below the plane of the roller conveyor 26 in its upper stack receiving and discharge position.

Figure 8:
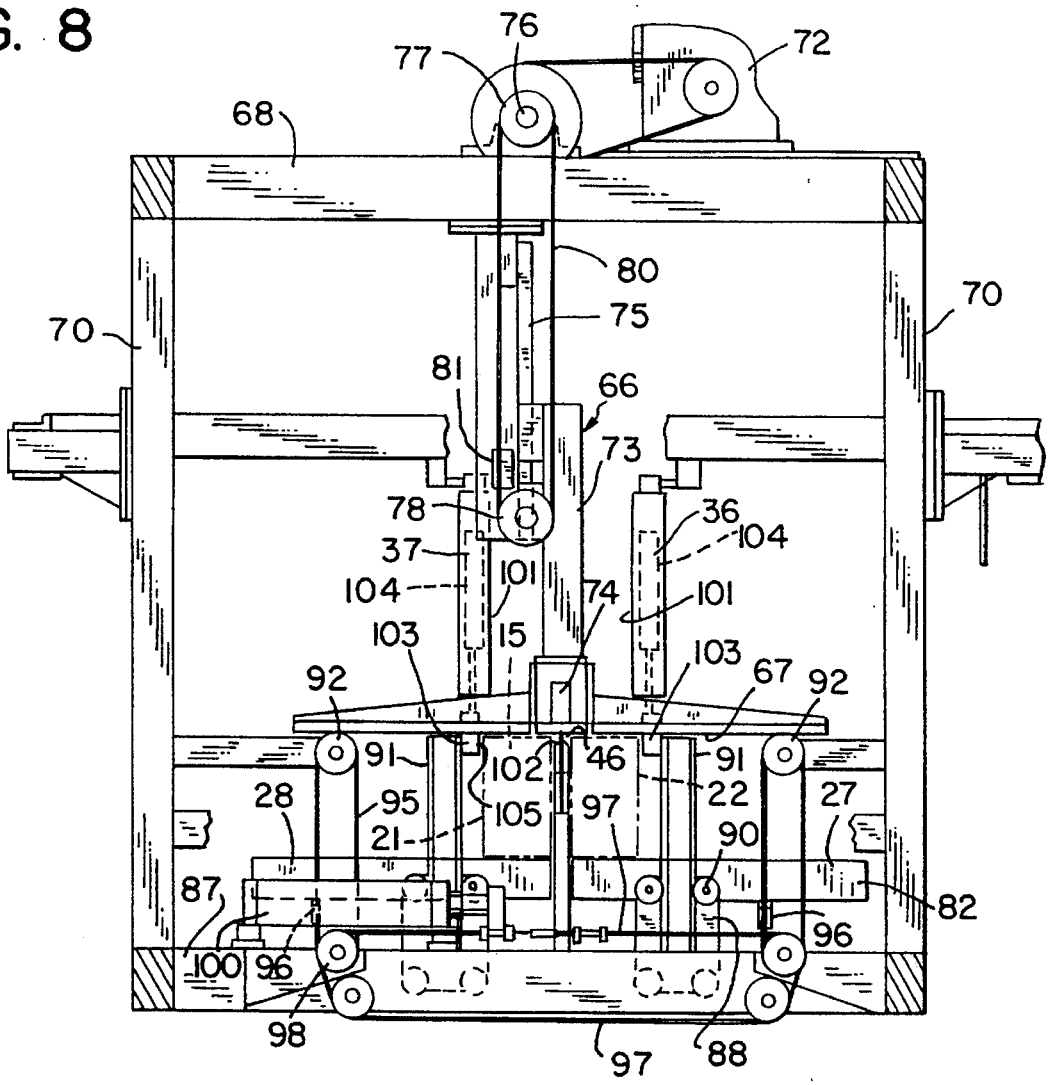
FIG. 8 is a side elevation similar to FIG. 4 showing the ram and stack supporting table in their lowermost positions after the stack has been moved through the slitting blade.

With a stack 15 of boxes 16 centered in the slitting station 25 over the slitting blade 46, in a manner which will be described in detail hereinafter, an overhead ram 66 (FIG. 4) having a lower flat horizontal pusher surface 67 is brought vertically downwardly into contact with the top of the stack 15 and, as it continues downwardly, overcomes an upward biasing force holding the upstream and downstream sections 27 and 28 of the roller conveyor 26 in their coplanar horizontal positions and pushes the stack downwardly through the blade to form the two half-sized stacks 47. Referring also to FIGS. 6–8, the ram is mounted on and suspended from an upper horizontal framework 68 which, in turn, is supported on the upper ends of lateral pairs of outer vertical support columns 70. The ram is driven vertically up and down by a servomotor 71 and reducer 72 mounted atop the horizontal framework 68. The ram includes a pair of spaced parallel vertical members 73 interconnected at their lower ends by a horizontal cross member 74. The pusher surface 67 is attached to the underside of the horizontal cross member. Each of the vertical members 73 is mounted to slide vertically on a track 69 defined by one of a pair of vertical guide members 75 (see FIG. 7). A horizontal driveshaft 76 is operatively connected to the reducer 72 and rotatably driven by the servomotor 71. Opposite ends of the driveshaft 76 each has an upper sprocket 77 secured thereto and a companion lower sprocket 78 is attached to the lower end of each vertical guide member 75. A timing belt 80 is entrained around each pair of sprockets 77 and 78. Each vertical member 73 of the ram 66 is clamped to one of the timing belts 80 with a belt clamp 81 such that synchronized movement of the timing belts 80 by driven rotation of the driveshaft 76 will result in downward or upward movement of the ram 66 to drive the stack 15 through the slitting blade 46 or provide a controlled upward return of the ram.

As indicated above, the two sections 27 and 28 which comprise the powered roller conveyor 26 in the slitting station are biased upwardly with a force sufficient to hold the stack 15 in the slitting position, but which biasing force is overcome by the downwardly descending ram 66. A dual pressure level control provides the lower level biasing force which is activated just prior to downward movement of the ram and held during slitting. A higher bias pressure level is otherwise maintained to allow pass through of stacks not being slit. The conveyor sections 27 and 28 are mounted to move together in synchronism under the influence of the ram and to return to their common upper stack receiving and discharge position as the ram retracts upwardly. As best shown in FIGS. 4–6 and 8, each of the upstream and downstream conveyor sections 27 and 28 is identical and includes a table-like frame 82 carrying a series of parallel rollers along its upper edge which rollers are driven in unison from below by direct frictional contact from a drive belt 84 in the manner of a conventional live roller conveyor. The drive belt 84 is driven by a motor 85 mounted on the underside of the frame 82. Each lateral side of the frame 82 has a downwardly depending guide plate 88 attached thereto and each guide plate carries four V-groove guide wheels 90 each vertical pair of which on one guide plate engages one of two opposite sides of a fixed vertical guide track 91 aligned with the guide plate 88, allowing the conveyor section 27 or 28 to move vertically up and down while the planes of their roller surfaces remain horizontal. The vertical pairs of guide wheels 90 on the opposite guide plate 88 bear against and travel along the flat surface of a fixed vertical guide bar 89. Each of the pairs of vertical guide tracks 91 and vertical guide bars 89 has operatively associated therewith an upper sprocket 92 and a lower sprocket 93. Each laterally opposite pair of lower sprockets 93 is fixed to a common timing shaft 94 and each pair of upper and lower sprockets 92,93 is interconnected with a timing belt 95 similar to the belts 80 used to drive the ram 66. Each side of the roller frame 82 is attached to one of the timing belts 95 with suitable belt clamps 96 such that synchronized vertical movement of the timing belts 95 by rotation of the timing shaft 94 causes the respective roller conveyor section 27 or 28 to move up or down. To assure synchronous movement of both the upstream and downstream roller conveyor sections, the ends of both timing shafts 94 on one side of the apparatus are interconnected with a master timing belt 97 entrained around master sprockets 98 fixed to the ends of the shafts 94. A biasing air cylinder 100 has its cylinder end fixed to the stationary lower frame 87 and its rod end clamped to the master timing belt 97. Pressurization of the cylinder 100 drives the master timing belt 97 horizontally and imparts rotary motion to the two synchronized timing shafts 94, resulting in synchronized vertical movement of the timing belts 95 and corresponding movement of the roller sections 27 and 28 clamped thereto to their upper positions where they are held by the air pressure in the cylinder. The lower level biasing air pressure is regulated to provide a slightly higher force than needed to maintain the roller conveyors in their initial stack receiving and discharge position when loaded with a stack 15 of boxes.

As previously indicated, the upstream squaring paddles 36 and downstream squaring paddles 37 provide a stack squaring and centering function, as well as a guiding function as the stack is being pushed downwardly through the slitting blade 46 by the ram 66. Thus, referring particularly to FIGS. 4, 8 and 12, each pair of paddles 36 has a pair of squaring faces 101 which engage the upstream face 22 of the stack, while a similar pair of squaring faces 101 on the downstream paddles 37 engage the downstream face 21 of the stack. However, as shown in the drawings, the lower ends of the paddles 36 and 37 lie just above the surfaces of the respective upstream and downstream conveyor sections 27 and 28 when the paddles are pivoted downwardly into their operative positions. As the conveyor sections descend along opposite sides of the blade holder 65 as a result of downward movement of the ram 66 and passage of this stack through the slitting blade 46, from the FIG. 4 to the FIG. 8 position, it will be appreciated that there are no upstream or downstream squaring faces 101 to restrain the respective downstream and upstream movement of the slit boxes comprising the two half-size stacks 47 resulting from the slitting operation. As the main stack 15 is moved downwardly through the blade, a single box 16 at a time is slit, and the slit halves are deflected in respective upstream and downstream directions as they pass over the tapered diverging surfaces 102 defining the nose or upper end of the blade holder 65. Such relatively uncontrolled movement of the half-size boxes will result in an unacceptable scattering and a gross loss of stack alignment.

To maintain substantial vertical alignment of the half-size stacks 47, each of the squaring paddles 36 and 37 includes a squaring face extender 103 mounted to extend downwardly from the hollow interior of the paddle by extension of an air cylinder 104 mounted therein and attached to the upper end of the extender. Box edge stops 105 on the extenders 103 are recessed from the main squaring faces 101 on the paddles 36 and 37 to accommodate the required parting of the box halves by an amount roughly equivalent to the width of the blade holder 46. The extender air cylinders 104 are operated in unison to extend with downward movement of the ram 66 and are timed to coincide with downward movement of the roller conveyor table sections 27 and 28.

Basic operation of the slitting apparatus 20 thus far described is as follows. With the powered rollers in both the upstream section 27 and downstream section 28 running and the slitting blade 46 operating, the downstream paddles 37 are pivoted downwardly into their operative positions disposed vertically over the downstream conveyor section 28 by extension of the paddle cylinders 44. A stack 15 passes from the infeed conveyor 24 into the slitting station 23 and is carried by the roller conveyor 26 over the running blade and into the squaring faces 101 of the downstream paddles 37. The upstream paddles 36 then rotate downwardly by extension of their respective paddle cylinders 44 into operative position with the squaring faces 101 adjacent the upstream face 22 of the stack. The drive cylinder 50 is extended to drive the splined driveshaft 56 and interconnected paddle drive belts 48 causing paddle pair 36 and paddle pair 37 to move toward one another, engage the stack faces and center the stack 15 precisely over the slitting blade 46. For the particular length of boxes 16 in the stacks being run, as measured between the opposite cut edges 18 in the direction of stack movement, the tooth clutch 58 is manually operated to move the paddle belts 48 and set the desired stack length. Immediately upon centering of the stack, the brake 59 on the driveshaft 56 is locked to fix the paddle pairs in position. Locking is necessary to prevent the diminishing number of uncut boxes in the descending stack from being held between the paddle pairs as a result of the decreasing resistance provided by fewer boxes to the air pressure applied by the paddle centering cylinder 50. If the paddles are not locked in centering position, the increasing pressure on the stack faces will cause the remaining boxes to bow. With the paddles locked in position, the ram 66 moves down onto the top of the stack and compresses the stack somewhat onto the supporting roller conveyor 26 until the low pressure level bias of the table air cylinder 100 is overcome and the conveyor sections 27 and 28 descend synchronously and the stack passes through the slitting blade. Simultaneously with downward movement of the supporting conveyor sections, the extender air cylinders 104 are activated to extend the squaring face extenders 103 vertically downward. The cut box halves part downstream and upstream into the edge stops 105 presented by the extenders and, simultaneously with movement of the uppermost box in the stack through the slitting blade, the brake 59 is released and the paddle drive cylinder 50 is retracted causing the paddle pairs 36 and 37 to move apart slightly further in equal opposite directions. The ram drive servomotor 71 is then reversed and the ram 66 is moved upwardly at a speed sufficient to follow the upward movement of the stack supporting conveyor sections 27 and 28 under the influence of the high level pressure of the biasing air cylinder 100. Return upward movement of the ram 66 is controlled to allow the horizontal pusher surface 67 to maintain a slight stack pressure which is sufficient to prevent the half-size boxes forming the two stacks 47 from being knocked further out of alignment as the conveyor sections reach their upper horizontal positions and the rod end of the biasing air cylinder 100 reaches the end of its stroke and engages a shock absorber 106 attached to a vertical frame member above the master timing belt 97. The additional distance by which the paddle pairs 36 and 37 are moved apart as the last box in the stack moves through the slitting blade provides clearance for the upward return of the half-size stacks 47 as a result of their parting movement past the blade holder 65. Upward movement of the ram, stacks 47 and stack supporting conveyor sections is also accompanied by retraction of the squaring face extenders 103 back into their respective paddles 36 and 37. At the same time, the downstream paddles 37 are rotated upwardly to their inoperative positions by retraction of the paddle cylinders 44. The control system again activates the squaring paddle drive cylinder 50 in a direction to again centering movement of both the upstream pair 36 and the downstream pair 37 of squaring paddles. However, because the downstream paddles 37 have already been moved to their inoperative positions out of the path of stack movement, only the upstream pair of paddles 36 will engage the upstream face 22 of the upstream half-size stack 47, re-squaring that stack and moving it into the adjacent face of the downstream half-size stack and automatically re-squaring that stack as well. This paddle motion also keeps narrow half-size stacks from tipping over when the conveyors 27 and 28 are started for discharge. Re-squaring movement of the upstream paddles 36 is followed immediately by startup of the motors 85 driving the rollers 82 for each of the sections of the powered roller conveyor 26 and the two half-size re-squared stacks 47 move out of the slitting station and onto the powered outfeed conveyor 30. The upstream squaring paddles 36 are also rotated upwardly to their inoperative positions.

Although the downward movement of the ram 66 compresses the boxes 16 in the stack somewhat against the force by which the stack supporting roller conveyor 26 is biased upwardly, there may still be a tendency for individual boxes to be displaced laterally as a result of the linear lateral movement of the slitting blade 46 as the boxes are slit. Such lateral displacement is, of course, only in one direction and, to prevent any substantial lateral displacement, a side stop apparatus 107 is positioned directly adjacent one lateral edge of the powered roller conveyor 26 in the slitting station 23. Referring also to FIGS. 9–11, the apparatus includes a pair of coplanar side stop faces 108, one disposed on each side of the blade holder 65 and between which the holder and slitting blade 46 pass. Each side stop face 108 is attached via a lateral extension air cylinder 110 to a vertically disposed side stop carriage 111. The side stop carriage 111 is, in turn, mounted for vertical reciprocal movement on a vertical slide track 112 under the influence of a vertical extension air cylinder 113. Both side stop faces 108 and their vertically reciprocable side stop carriages 111 operate in unison during the slitting process in the following manner. Simultaneously with entry of a stack 15 into the slitting station 25, the vertical air cylinders 113 are extended to place the side stop carriages 111 in their uppermost position and the lateral extension air cylinders 110 are retracted to position the side stop faces 108 laterally outside the path of stack movement. Just prior to downward movement of the ram 66, the side stop faces 108 are extended inwardly into engagement with the folded edges 17 of the stack of boxes and simultaneously vertical extension air cylinders 113 are de-energized thereby allowing the side stop carriages 111 to move downwardly with downward movement of the boxes through the slitting blade. Downward movement of the side stop face 108 with the stack prevents possible box damage from sliding friction between the box edges and the stop faces. At the bottom of the stroke, the side stop faces 108 are retracted and the side stop carriages 111 are moved upwardly as the next stack enters the slitting station 25. The side stop apparatus 107 is then back to its initial position.

Figure 14:
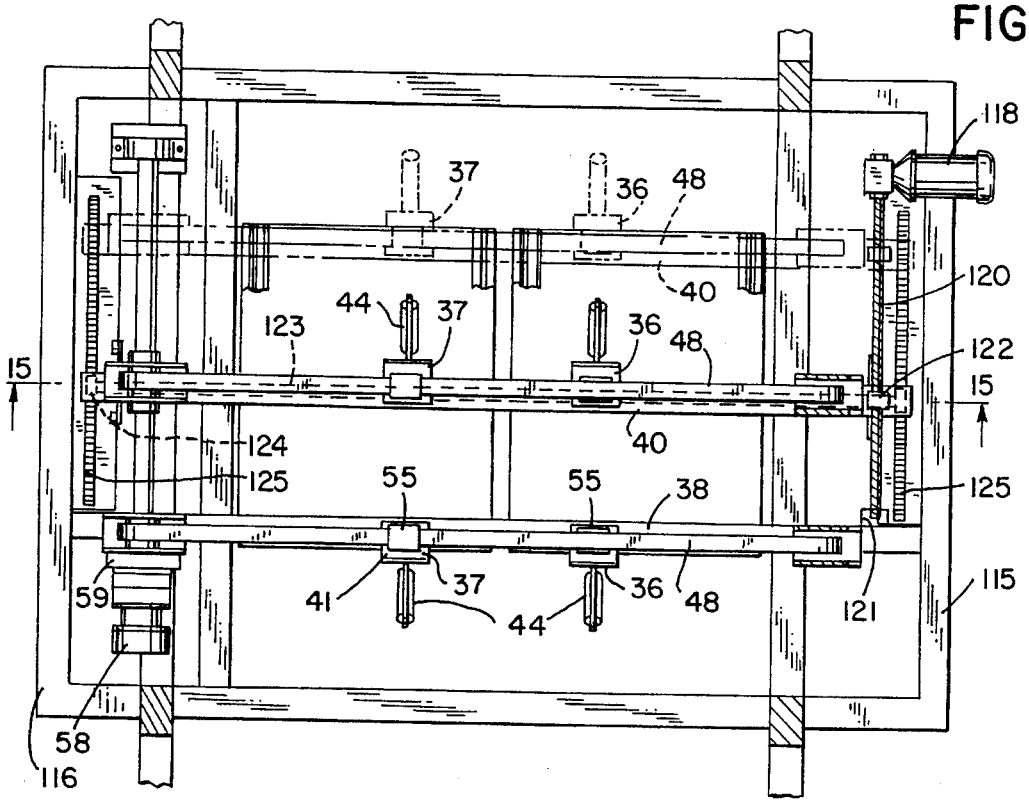
FIG. 14 is a top plan view of the apparatus shown in FIGS. 12 and 13.
Figure 15:
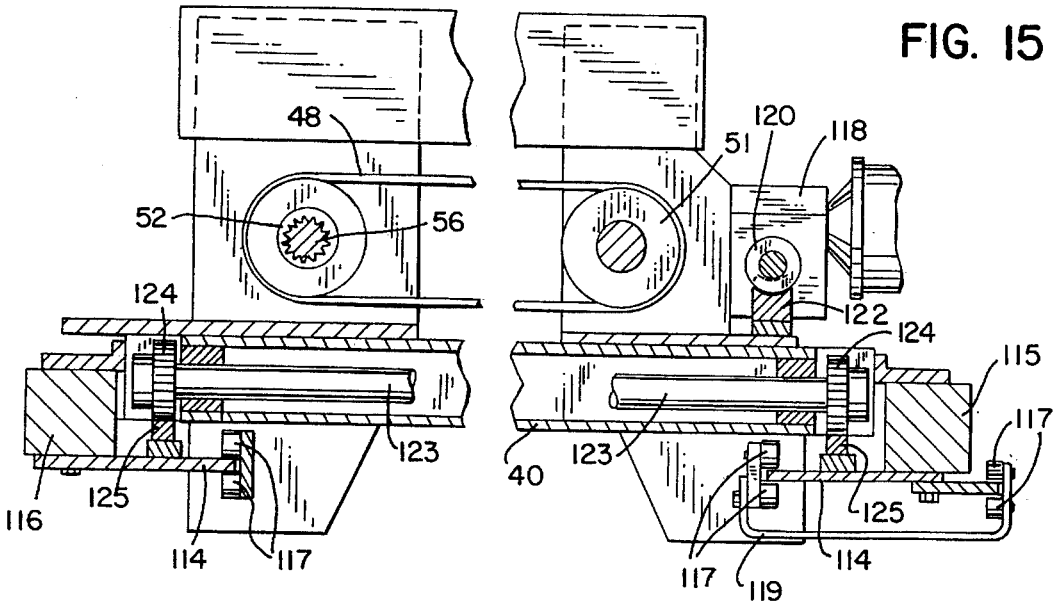
FIG. 15 is an enlarged vertical section taken on line 15—15 of FIG. 14.

To accommodate stacks of boxes of varying width in the cross machine direction, the lateral distance between the paddles comprising the upstream pair 36 and the same lateral distance between the paddles comprising the downstream pair 37 is adjustable. As indicated earlier, one of each upstream squaring paddles 36 and downstream squaring paddles 37 is mounted for adjustable movement along the fixed paddle supporting beam 38 while the other pair of upstream and downstream paddles 36 and 37 is similarly mounted for reciprocal sliding movement along the laterally adjustable paddle supporting beam 40. To vary the distance laterally and referring also to FIGS. 14 and 15, the adjustable supporting beam 40 is mounted at its opposite ends on lateral tracks 114 attached to an upstream cross beam 115 and a downstream cross beam 116. At each end of the beam 40, upper and lower pairs of cam wheels 117 are attached to the beam and ride along the upper and lower surfaces of one of the tracks 114 to carry the beam 40 and attached upstream and downstream squaring paddles laterally to vary the lateral distance from the fixed beam 38 and its pair of upstream and downstream squaring paddles. A motor/reducer 118 is mounted on one end of the upstream cross beam 115 and drives a lead screw 120 extending laterally parallel to the cross beam 115 to a support bearing 121 mounted near the opposite end of the beam 115. A lead screw nut assembly 122 is attached to the upstream end of the adjustable support beam 40 and operatively attached to the lead screw such that rotation of the lead screw by the motor reducer 118 causes the nut assembly to move along the screw, carrying with it the attached beam 40 which rolls along the tracks 114 supporting the opposite ends of the beam. To assure that the downstream end of beam 40 moves uniformly with the lead screw driven upstream end, a rotatable timing shaft 123 extends through the open interior of the beam 40 and has fixed to its opposite ends pinions 124. Each of the pinions engages a toothed rack 125 attached to one of the lateral tracks 114 and extending along its respective cross beam 115 or 116 substantially the full length of the lead screw 120. It should be noted that the carriage 119 for the upstream cam wheels 117, carrying the end of beam 40, is also used for mounting the laterally adjustable side tamp 11 (see FIG. 2).

Figure 18:
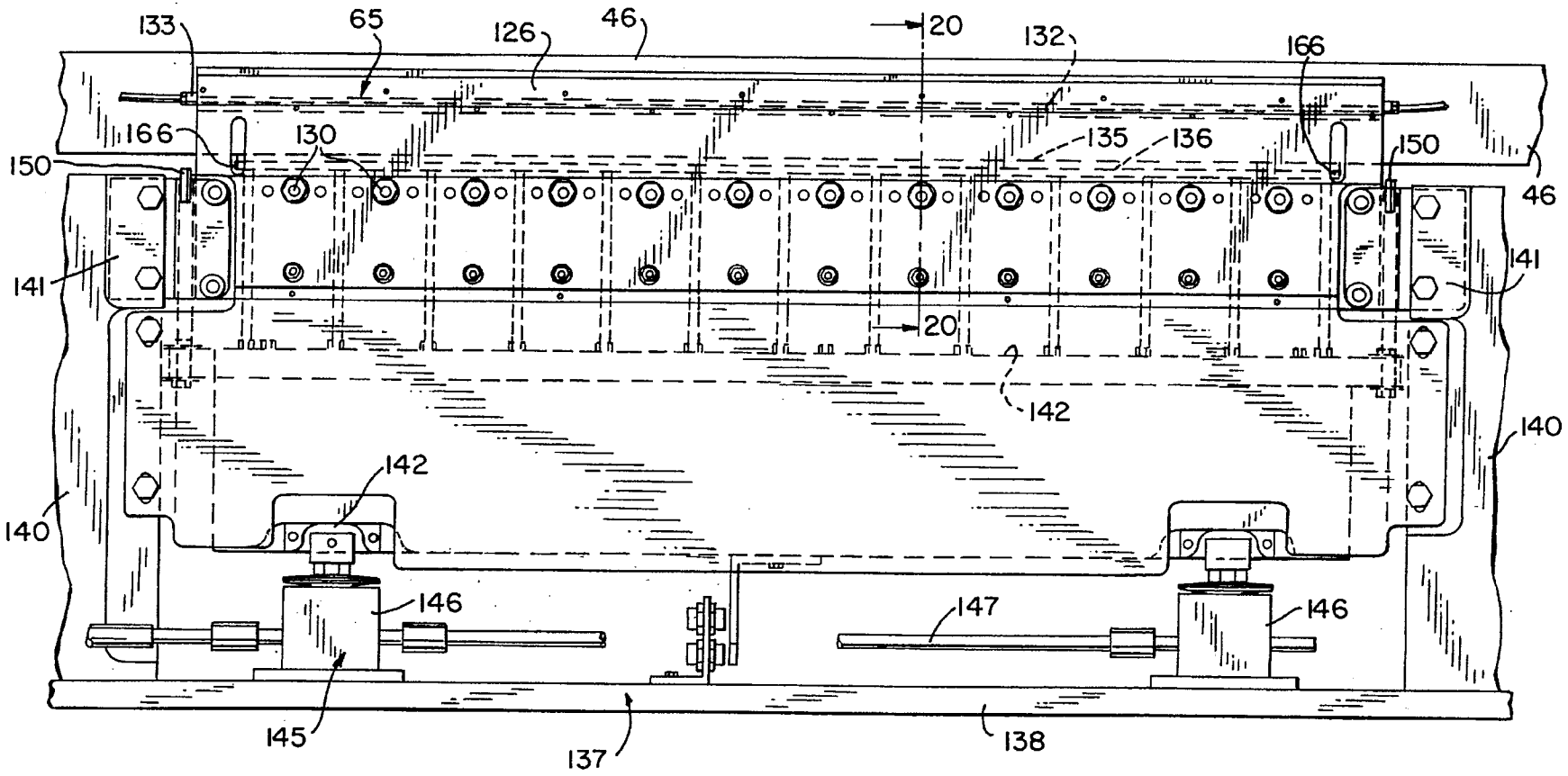
FIG. 18 is an elevation view of the slitting blade holder.

Referring also to FIGS. 18–20, the blade holder 65 comprises a pair of jaws 126 which substantially enclose and carry the slitting blade 46 for sliding movement in the cutting plane 60. The jaws 126 are biased to enclose the side faces of the blade between a pair of lateral bearing surfaces, preferably in the form of steel wear strips 127 having low friction face coatings. The strips 127 are set into the upper end of each jaw and held in place by a series of machine screws 129 running the length of the jaws. The total height of the slitting blade 46 may be, for example, 3⅜ inches (8.5 cm), but only about 0.4 inch (10 mm) of the blade including the upper cutting edge 61 is exposed. The noses of the jaws and corresponding adjacent portions of the wear strips 127 are tapered to form the diverging surfaces 102 over which the slit box halves pass and part as the stack moves downwardly through the blade. The total included angle between the surfaces 102 is preferably about 45° and the surfaces are polished, all to enhance cutting efficiency and reduce box edge crush. To provide a light biasing force of the wear strips 127 against the side faces of the slitting blade 46, the jaws 126 are pivotally attached for rotation on a pivot axis 128 defined by a series of T-bolts 130 mounted along the length of the blade holder. The bottom ends of the jaws are biased apart by a series of bias springs 131, also mounted along the length of the blade holder, the combined force of which closes the wear strips 127 against the blade, as indicated. In an alternate construction, the bias springs 131 may be eliminated and replaced with a series of solid set screws.

Preferably, the wear strips 127 have a series of elongate apertures 132 along their lengths which are connected by a common supply duct to a source of compressed air via an appropriate connection 133 at one end of each of the jaws. Supplying compressed air, which preferably has oil entrained therein, provides an air bearing between the wear strip surfaces and the side faces of the slitting blade to allow close guiding contact of the blade without excessive wear.

The jaws 126 define an open interior portion 144 which houses a vertically adjustable blade support 134 upon which the butt edge 62 of the slitting blade is slidably supported as the blade travels through the blade holder. The blade support 134 includes an upper carbide bar 135 which provides direct sliding support for the blade. The carbide bar 135 is preferably formed of three identical longitudinally abutting bar sections, each having a square cross section and being repositionable to provide four wear surfaces before replacement. A square cross section steel bar 136 of the same size and shape as the three-piece carbide bar 135 supports the latter from below and the bars are vertically adjustable (in a manner to be described) to provide the desired upper blade edge exposure and move the blade vertically to maintain such exposure as the blade wears.

The blade holder 65 is mounted on and supported by a mounting frame 137 secured to the lower stationary frame 87. The mounting frame 137 includes a generally horizontal base 138 having a pair of upwardly extending blade holder mounts 140 on opposite ends thereof. The opposite ends of one of the jaws 126 of the blade holder 65 are attached to the upwardly extending blade holder mounts 140 by mounting brackets 141. This places the nose of the blade holder slightly below the horizontal plane of the roller conveyor 26 in the slitting station. To adjust the amount of blade edge exposure beyond the nose of the blade holder jaws 126, the slitting blade 46, its supporting carbide bar 135 and the backing bar 136 are moved vertically together by an adjustment plate 142 which is mounted for vertical sliding movement between the base 138 of the blade holder mounting frame 137 and the blade holder 65. A series of parallel spaced vertically extending pins 143 are attached to the upper edge of the adjustment plate and extend upwardly through open slots between the abutting portions of the lower halves of the jaws 126. The upper ends of the pins 143 extend into the open portion 144 of the blade holder in which the bars 135 and 136 are disposed for vertical sliding movement. The pins 143 engage the underside of the steel bar 136 such that adjustable vertical movement of the adjustment plate 142 will result in vertical movement of the cutting blade vertically between the blade holder jaws 126. Vertical movement of the adjustment plate 142 and thus vertical positioning of the slitting blade within the blade holder 65 is provided by an actuator mechanism 145 mounted between the base 138 of the mounting frame and the underside of the adjustment plate 142. The actuator mechanism 145 includes a pair of lead screw actuators 146 attached to the base 138 adjacent opposite ends of the adjustment plate 142 and having their upper screw ends rotatably attached to the lower edge of the adjustment plate. The actuators 146 are connected by a common driveshaft 147 and are timed to operate together within a very close tolerance of less than 0.003 inch (0.08 mm). The actuators are driven by a motor 148.

Figure 16:
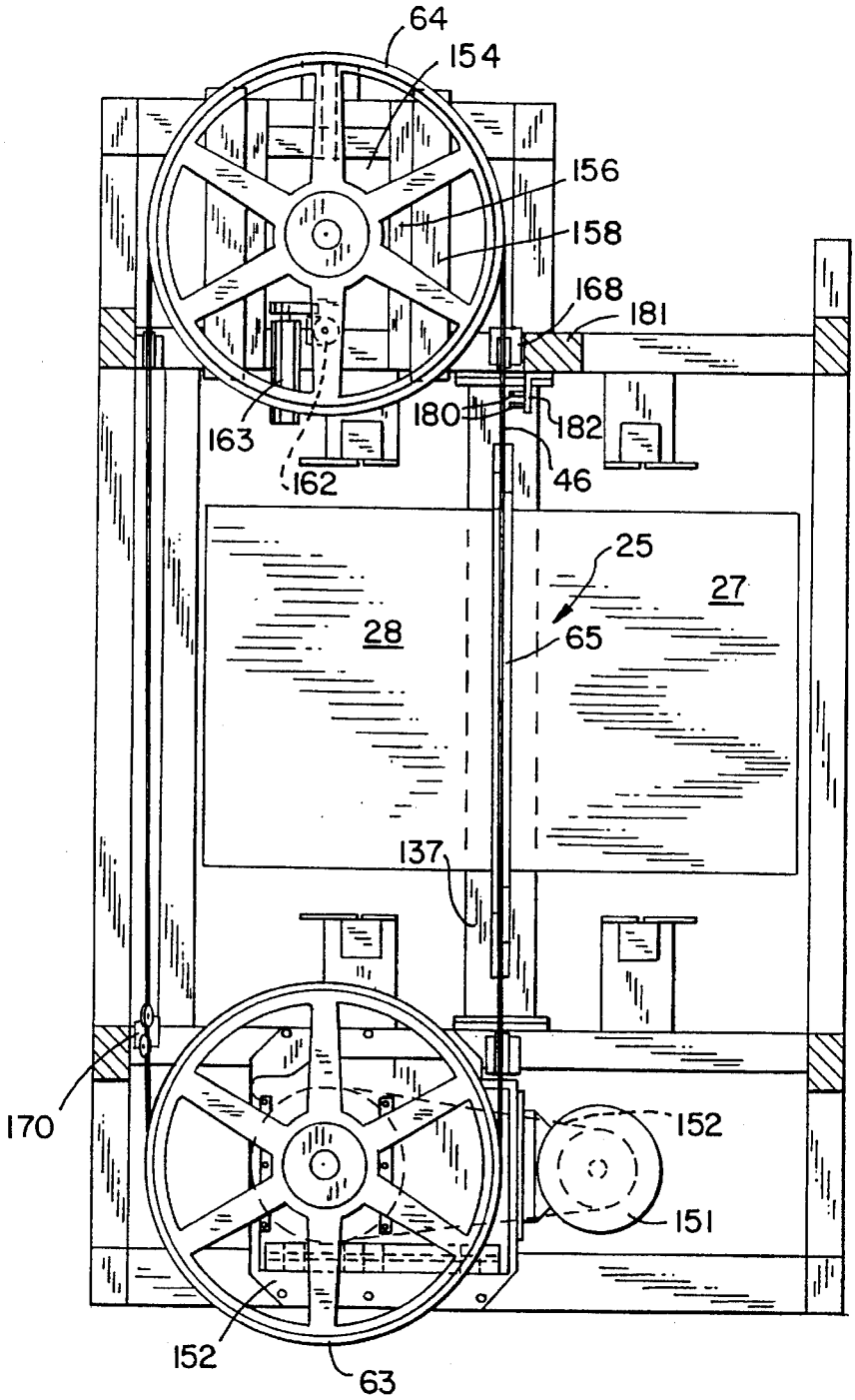
FIG. 16 is a top plan view of the slitting blade drive and holding mechanisms.

As indicated previously, it is desirable to maintain a blade exposure dimension of 0.4 inch (10 mm) which is greater than the thickness of a conventional double face corrugated paperboard sheet, yet adequate to slit a double wall sheet without crushing. The blade edge exposure is preferably maintained within ±0.030 inch (0.8 mm) and a sensing system is provided to maintain the desired blade edge exposure automatically. A pair of upper and lower blade edge height sensors 180 are mounted on a bracket 182 which is attached to a vertical frame member adjacent one end of the blade holder, as shown in FIG. 16. The sensors detect upper and lower limits of blade height and the signals are processed to automatically operate the motor 148 to assure that the slitting blade tracks with the desired blade edge exposure. This blade tracking adjustment is utilized to move the blade vertically upwardly to adjust for blade wear. Blade edge wear is caused by abrasive action of the paperboard cut in the slitting operation of the blade and the use of an automatic blade edge sharpening device to be described.

Figure 17:
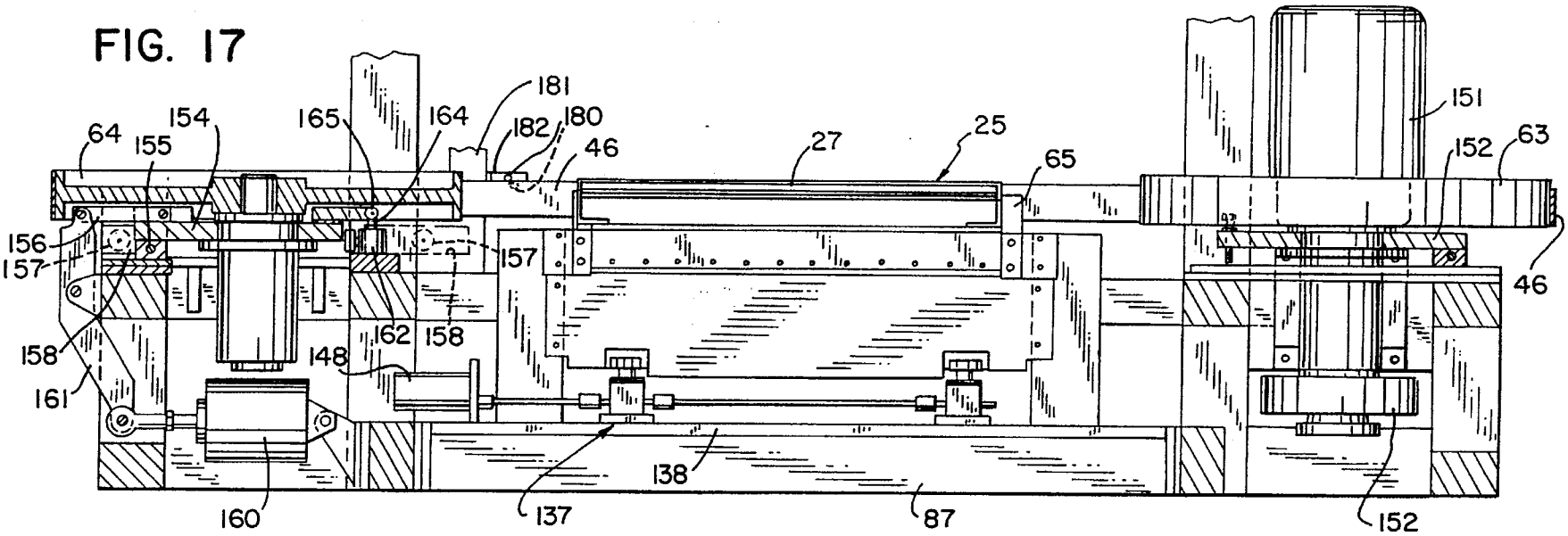
FIG. 17 is an end elevation of the apparatus shown in FIG. 16 viewed in the downstream direction.

As also shown in FIGS. 16 and 17, the blade drums 63 and 64 around which the slitting blade 46 operates are mounted to the lower stationary frame 87 on lateral opposite sides of the slitting station 25 and offset in a downstream direction as shown. Blade drum 63 is rotatably mounted on a fixed base plate 152 and driven by a motor/reducer 151 with a conventional belt drive 153. The opposite idler blade drum 64 is mounted for two modes of adjustment to control blade tension and to control the biasing force of the blade butt edge 62 on the carbide support bar 135 in the blade holder. Thus, blade drum 64 is rotatably mounted on a pivotal drum support plate 154 via a pivot pin 155 to a horizontally adjustable base plate 156. The base plate 156 is supported for horizontal movement toward and away from the driven blade drum 63 by cam wheels 157 running along a pair of opposite C-channel members 158 attached to the supporting frame 87. Blade tension is maintained by an air cylinder 160 mounted on the frame 87 and operatively attached to one edge of the adjustable base plate 156 by a blade tension linkage 161. A blade biasing actuator 162 is attached to the adjustable base plate 156 on the edge opposite the tension linkage 161. The actuator is driven by a small motor 163 and includes an actuating lead screw 164 having an upper end in engagement with a cam bearing 165 attached to the pivotal drum supporting plate 154. Operation of the biasing actuator 162 to move the lead screw 164 upwardly will result in upward pivotal movement of the support plate 154 about the pivot pin 155 and against the force of blade tension. Opposite movement of the lead screw 164 in the downward direction results in opposite pivotal movement of the drum supporting plate 154 under the influence of slitting blade tension.

It has been found that careful control of the biasing force of the butt edge 62 of the slitting blade 46 on the wear surface of the carbide bar 135 in the blade holder is extremely important to avoid, on the one hand, excessive blade and bar wear if the blade is biased against the carbide bar with too great a force and, on the other hand, undesirable upward tracking of the blade and potentially damaging shock loadings if the biasing force is insufficient and contact between the blade and the carbide wear bar 135 is lost. Control of the biasing actuator 162 is based on signals generated by temperature sensors 166 (FIG. 18) mounted at the ends of the steel bar 136 which supports the carbide wear bar 135 in the blade holder 65 as previously described. If the temperature sensed at either end of the blade holder moves above or below set limits, the indication is that the blade is exerting, respectively, too much or too little pressure on the carbide support 135. The control system, such as a conventional PLC, signals the biasing actuator 162 to move the pivotal drum supporting plate 154 in the appropriate direction to re-establish the proper temperature and, therefore, the desired level of uniform force of the blade on the carbide support. If the actuating lead screw 164 is moved upwardly, causing the drum support plate to be lifted, the blade will track downwardly, and vice versa. The temperature range is selected to maintain a downward preload of the slitting blade on the carbide support 135 to prevent any bounce as a stack load is imposed on the blade edge and to eliminate any tendency of the blade to track upwardly off the drums during operation. Actual blade movement effected by the biasing actuator 162 is extremely small. For example, the actuator may be constructed and operated to provide drum support plate movement of 0.0025 inch (0.06 mm) with a one second operating pulse.

It has been found to be very important to assure that the lower butt edge 62 of the slitting blade does not move out of contact with the carbide supporting bar 135 in spite of automatic control by the biasing actuator 162. The ram 66 may operate with a downward force of 3,000 pounds (13,0000N) and the resultant shock loading which would result, if the blade were running off the supporting carbide bar, could cause damage to the blade, blade holder or blade drive system. Blade height sensors 150 are attached to the upper edges of the blade holder mounts 140 to monitor the distance to the butt edge of the slitting blade. If the preset distance is exceeded, the signal from the sensor causes the controller to disable operation of the ram.

It is important both for maintenance of blade life and assurance of slit quality to provide blade lubrication and blade sharpening. Blade lubrication and sharpening are described in U.S. Pat. Nos. 5,090,281and 5,165,314 as applied to circular slitting blades for corrugated paperboard web and sheet materials. However, these devices are readily adaptable to lubricate and sharpen a linear slitting blade 46 of the type used in the present apparatus. Most conveniently, the lubricating device 168 is mounted near the upstream end of the slitting run of the blade and applies a continuous metered amount of a lubricant to the side faces of the blade which lubricant is beneficially transferred to the faces of the wear strips 127 and carbide wear bar 135 as well. The sharpening device 170 is most conveniently mounted on the return run of the slitting blade downstream of the slitting station.

A blade having an initial total height of 3⅜ inches (8.6 cm) may be operated to a final blade height of 2⅛ inches (5.4 cm) before replacement. Thus, the blade tracking system is capable of providing a total of 1¼ inches (3.2 cm) total upward blade adjustment. The slitting blade may be operated at a speed of about 1,200 fpm (6 m/sec) and the ram 66 operated at a vertical downward speed of about 120 fpm (0.6 m/sec). The resultant ratio of horizontal to vertical movement of the blade edge in a ratio of 10:1 results in a very small effective angle of linear movement of the blade through the stack, i.e. about 6°. However, by maintenance of proper blade alignment, sharpness and lubrication, the angle may be increased substantially, e.g. by reducing blade speed or increasing ram velocity, and cut quality still maintained.

Various modes of carrying out the present invention are contemplated as being within the scope of the following claims particularly pointing out and distinctly claiming the subject matter which is regarded as the invention.

We claim:

1. A method for slitting a stack of corrugated paperboard sheets having a pair of opposite parallel cut edges, said method comprising the steps of:

(1) moving the stack of sheets in a direction normal to the cut edges onto a stack supporting table in a slitting station;

(2) positioning a downstream squaring device in the path of movement in the slitting station to engage a stack face defined by the downstream cut edges of the stacked sheets;

(3) positioning an upstream squaring device in the path of stack movement adjacent the stack face defined by the upstream cut edges of a stacked sheets;

(4) mounting a slitting blade below the stack supporting table in the slitting station, said blade having a horizontally disposed slitting edge moveable transversely with respect to the path of sheet movement, said blade edge disposed upwardly and positioned in a vertical cutting plane parallel to the cut edges of the stacked sheets in the slitting station;

(5) moving said downstream and upstream squaring devices toward one another to engage the respective stack faces and center the stack in the cutting plane; and, (6) moving the stack supporting table and the stack of sheets vertically downward through the slitting edge of the blade to slit the stack in the cutting plane and form two stacks of smaller sheets.

2. The method as set forth in claim 1 including the step of extending said downstream and upstream squaring devices vertically downwardly in response to downward movement of the stack supporting table to engage the downstream and upstream edges and limit parting movement of the smaller sheets forming, respectively, the downstream and upstream stacks.

3. The method as set forth in claim 1 including the subsequent steps of:

(1) moving the downstream squaring device out of the path of stack movement; and, (2) moving the upstream squaring device in the downstream direction to move the upstream stack of smaller boxes into engagement with the downstream stack and re-square the stack faces.

4. The method as set forth in claim 1 including the subsequent steps of:

(1) moving said squaring devices away from one another; and, (2) moving the supporting table and the two stacks of smaller sheets vertically upwardly to the initial supporting table position.

5. An apparatus for slitting a stack of corrugated paperboard sheets having opposite parallel cut edges, said apparatus comprising:

a slitting station including a lower stack supporting table;

means for moving the stack in a direction normal to the cut edges onto the stack supporting table;

a downstream squaring device movable into the path of stack movement in the slitting station and having a first squaring face adapted to engage a stack face defined by the downstream cut edges of the stacked sheets;

a slitting blade mounted in the slitting station and movable transversely with respect to the path of stack movement, said blade having a horizontally disposed slitting edge positioned in a vertical cutting plane parallel to the cut edges of the stacked sheets in the slitting station;

an upstream squaring device movable into the path of stack movement in the slitting station and having a second squaring face adapted to engage a stack face defined by the upstream cut edges of the stacked sheets;

centering means mounting the downstream and upstream squaring devices for movement parallel to the direction of stack movement and for squaring and centering the stack in the cutting plane; and, means for moving the stack supporting table and the stack of sheets vertically relative to and through the slitting edge of the blade to slit the stack on the cutting plane and form two stacks of smaller sheets.

6. The apparatus as set forth in claim 5 wherein said stack supporting table and moving means comprises a conveyor having upstream and downstream sections positioned on opposite sides of the cutting plane.

7. The apparatus as set forth in claim 5 wherein said supporting table is movable downwardly from an upper stack receiving and discharge position above the blade edge.

8. The apparatus as set forth in claim 7 including:

a stack-engaging ram mounted in the slitting station above the supporting table and the stack of sheets supported thereon;

an upwardly-biased retracting support operative to exert an upward force sufficient to hold the table and stack in the upper position; and, a ram drive operative to move said ram into engagement with the top of the stack, to overcome the upward force of said biased support and to move the stack and table downwardly past the blade edge.

9. The apparatus as set forth in claim 5 wherein said centering means comprises:

a centering drive supporting said squaring devices for common linear reciprocating movement; and, said centering drive operative to bring said first and second squaring faces into a centering position in contact with the respective downstream and upstream stack faces in vertical planes equidistant from the cutting plane.

10. The apparatus as set forth in claim 9 wherein said centering drive includes means for locking said squaring devices in the centering position.

11. The apparatus as set forth in claim 5 wherein said blade edge is maintained in a fixed horizontal plane and said table and stack are supported for downward movement past the blade edge, and said squaring devices are maintained fixed above the blade during downward movement of the stack, said apparatus further comprising:

a squaring face extender for each squaring device;

each extender mounted to extend downwardly from the lower end of the squaring device in response to downward movement of the stack to present downstream and upstream edge stops for engagement by the downstream and upstream edges and to limit parting movement of the smaller sheets forming the respective downstream and upstream stacks.

12. The apparatus as set forth in claim 5 wherein said downstream and upstream squaring devices each comprise a pair of independently positionable paddles having coplanar face portions defining, respectively, said first and second squaring faces.

13. The apparatus as set forth in claim 5 wherein said centering means is operable to move the upstream squaring device in the downstream direction, after formation of the two stacks of smaller sheets and movement of the downstream squaring device out of the path of stack movement, to move the two stacks into mutual engagement and resquare the stack faces.

14. The apparatus as set forth in claim 5 including means upstream of the slitting station for squaring the lateral edges of the stack of sheets.

15. The apparatus as set forth in claim 5 including a lateral side stop in the slitting station having a vertical stop face positionable in the plane of a lateral stack face defined by a plane normal to the cutting plane to maintain alignment of the sheet edges forming said lateral stack face during slitting.

* * * * *